US008783846B2

(12) United States Patent
Ito et al.

(10) Patent No.: US 8,783,846 B2
(45) Date of Patent: Jul. 22, 2014

(54) PAPER USED IN AN INKJET PRINTER, INKJET PRINTER, AND PRELIMINARY EJECTION METHOD FOR AN INKJET PRINTER

(71) Applicant: Seiko Epson Corporation, Tokyo (JP)

(72) Inventors: Kiyoshi Ito, Matsumoto (JP); Naoki Kobayashi, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 13/676,331

(22) Filed: Nov. 14, 2012

(65) Prior Publication Data

US 2013/0120489 A1 May 16, 2013

(30) Foreign Application Priority Data

Nov. 15, 2011 (JP) ..... 2011-249414

(51) Int. Cl.
*B41J 2/01* (2006.01)
*B41J 29/38* (2006.01)

(52) U.S. Cl.
USPC ..... 347/101; 347/105; 347/106; 347/14; 347/16

(58) Field of Classification Search
USPC ..... 347/14, 16, 101, 105, 106
See application file for complete search history.

(56) References Cited

U.S. PATENT DOCUMENTS

| | | | | |
|---|---|---|---|---|
| 4,743,130 | A | 5/1988 | Katagiri et al. | |
| 7,407,258 | B2 | 8/2008 | Nakahara et al. | |
| 8,342,677 | B2 * | 1/2013 | Kobayashi | 347/104 |
| 2002/0015086 | A1 * | 2/2002 | Shiraiwa | 347/172 |
| 2005/0162452 | A1 | 7/2005 | Kachi | |
| 2006/0055715 | A1 | 3/2006 | Nakahara et al. | |
| 2006/0214961 | A1 | 9/2006 | Nakahara | |
| 2010/0033529 | A1 * | 2/2010 | Komuro | 347/16 |

FOREIGN PATENT DOCUMENTS

| | | | |
|---|---|---|---|
| EP | 0 798 123 | A2 | 10/1997 |
| EP | 2455224 | A1 | 5/2012 |
| JP | 2003170579 | A | 6/2003 |
| JP | 200676247 | A | 3/2006 |
| JP | 2006297905 | A | 11/2006 |
| JP | 2007144792 | A | 6/2007 |
| WO | 2011007487 | A1 | 1/2011 |

OTHER PUBLICATIONS

EP Search Report dated Mar. 5, 2013 (7 pages).

* cited by examiner

*Primary Examiner* — Sarah Al Hashimi
(74) *Attorney, Agent, or Firm* — Lowe Hauptman & Ham, LLP

(57) ABSTRACT

An inkjet printer includes an inkjet head having a nozzle to eject ink in a first direction for recording information. A platen that has an ink storage unit for storing the ink ejected from the nozzle. The platen is opposite the inkjet head and configured to guide paper formed with an open part. A paper feed unit is provided in the inkjet printer and is configured to convey the paper in a second direction cross to the first direction, and to move the paper over the platen. A print control unit is further provided in the inkjet printer and is configured to cause the nozzle to eject ink into the ink storage unit when the open part of the paper is conveyed to a position opposite the inkjet head.

7 Claims, 5 Drawing Sheets

PAPER USED IN AN INKJET PRINTER, INKJET PRINTER, AND PRELIMINARY EJECTION METHOD FOR AN INKJET PRINTER

BACKGROUND

1.Technical Field

The present invention relates to paper that is used in an inkjet printer to record information, to an inkjet printer, and to a preliminary ejection method for an inkjet printer.

2.Related Art

Inkjet printers eject ink as droplets from plural nozzles in an inkjet head to record information on recording paper. If an inkjet printer is not used for a certain period of time, air bubbles can form in the nozzles and the viscosity of the ink can increase. Foreign matter such as paper dust from the recording paper can also collect around the nozzles. As a result, some inkjet printers eject ink at specific times to eliminate such causes of ink ejection problems. This operation is called preliminary ejection or flushing.

Serial inkjet printers in which the inkjet head moves perpendicularly to the conveyance direction of the recording paper, and inkjet printers that record information on cut-sheet paper, perform the preliminary ejection operation in an area outside the recording area of the recording paper or between sheets.

In order to increase the printing speed, inkjet line printers that record information on the recording paper using an inkjet head that is held stationary at the recording position and is wider than the recording area of the recording paper have also been introduced. Continuous paper is commonly used as the recording paper in this type of inkjet printer. To ensure that the preliminary ejection operation is performed, inkjet printers that provide a preliminary ejection area on the recording paper and perform the preliminary ejection operation into this preliminary ejection area have also been introduced. See, for example, Japanese Unexamined Patent Appl. Pub. JP-A-2007-144792.

A problem with this type of inkjet printer, however, is that an unnecessary pattern is recorded on the recording paper, resulting in an undesirable appearance. In addition, because a concentrated amount of ink is ejected to eliminate the causes of ejection problems, the ink takes longer to dry than normal text and images, and the recording paper and parts along the conveyance path can become soiled. Particularly when the recording paper is label paper having labels continuously affixed to a web liner with a gap therebetween, glassine paper or other coated paper is used as the liner to improve separation of the labels from the liner. This exacerbates the problem.

SUMMARY

The present invention is directed to solving at least part of the foregoing problem.

Inkjet paper according to one aspect of the invention has a recording area where information is recorded; a non-recording area where information is not recorded; and an open part formed in the non-recording area.

Preferably, the open part has a first opening, and a second opening that is formed separated from the first opening in a first direction and a second direction that is perpendicular to the first direction.

In another aspect of the invention the recording area has a first width in the first direction; and the length from one end of the first opening in the first direction to the other end of the second opening in the first direction is equal to the first width or is longer than the first width.

Further preferably, the open part is open along the first direction of the recording area.

In another aspect of the invention, the recording area has a first width in a first direction; and the open part has a second width that is equal to the first width in the first direction or is greater than the first width.

Inkjet paper according to the invention has an open part with a length that covers the length of the recording area, that is, the area to which the inkjet head of the inkjet printer can eject ink, in the direction perpendicular to the conveyance direction in which the paper is conveyed in the inkjet printer, that is, across the width of continuous inkjet paper. As a result, the inkjet head can flush ink through this open part. The flushed ink can therefore be prevented from landing on the surface of the continuous inkjet paper. The appearance of the recording area of the continuous inkjet paper can therefore be maintained, and soiling of the continuous inkjet paper and area around the paper feed path can be reduced.

Further preferably, the first opening is formed at one side of the recording area in the second direction; and the second opening is formed at the other side of the recording area in the second direction.

The continuous length of the open part across the paper width can thus be reduced in the inkjet paper according to this aspect of the invention. A loss of rigidity in the inkjet paper can therefore be prevented. As a result, stable conveyance of the inkjet paper can be maintained while ink can be flushed through these openings. The flushed ink can therefore be prevented from landing on the surface of the inkjet paper.

Inkjet paper according to another aspect of the invention preferably also has a label with a recording side on which information is recorded and an adhesive side coated with adhesive; and a liner to which the label is affixed. The recording area is on the recording surface of the label, and the open part is formed in an area where the label is not affixed to the liner.

This aspect of the invention enables using label paper having labels affixed with a specific gap therebetween to a liner as the inkjet paper.

Inkjet paper according to another aspect of the invention preferably has a perforation formed in the first direction of the first opening.

This aspect of the invention enables using fanfold paper having perforations formed at a specific interval along the length of the paper as continuous inkjet paper.

Another aspect of the invention is an inkjet printer having an inkjet head that records information with a nozzle that ejects ink in a first direction; a platen that has an ink storage unit that is opposite the inkjet head and stores ink ejected from the nozzle, and guides paper formed with an open part; a paper feed unit that conveys the paper in a second direction perpendicular to the first direction, and moves the paper over the platen; and a print control unit that ejects ink into the ink storage unit when the open part of the paper is conveyed to a position opposite the inkjet head.

Preferably, the paper has a first opening, and a second opening formed separated from the first opening in the first direction and the second direction; and the print control unit ejects ink into the ink storage unit from the nozzle of the inkjet head opposite the first opening when the first opening is conveyed to a position opposite the inkjet head, and ejects ink into the ink storage unit from the nozzle of the inkjet head opposite the second opening when the second opening is conveyed to a position opposite the inkjet head.

In another aspect of the invention, the inkjet printer also has an open part detection unit that detects an open part formed in the paper; and the print control unit determines the open part of the paper was conveyed to a position opposite the inkjet head based on output from the open part detection unit.

In another aspect of the invention, the paper has a recording area to which information is recorded; and the print control unit ejects ink from the nozzle of the inkjet head and records the information in the recording area when the recording area of the paper is conveyed to a position opposite the inkjet head.

Further preferably, the inkjet head is an inkjet line head disposed to a fixed position opposite the platen with the ink storage unit.

The open part detection unit of the inkjet printer according to this aspect of the invention can detect the position of the open part of the inkjet paper conveyed by the paper feed unit. Ink can also be ejected from the inkjet head through the open part into a waste ink storage unit disposed at a position opposite the inkjet head with the paper feed path therebetween to flush the inkjet head. The inkjet head can therefore be flushed when inkjet paper is in the paper feed path while preventing the flushed waste ink from landing on the surface of the inkjet paper. The inkjet printer can therefore maintain the appearance of the recording part of the inkjet paper, and reduce soiling of the inkjet paper and the area around the paper feed path.

Another aspect of the invention is a preliminary ejection method for an inkjet printer, including steps of: conveying paper formed with an open part in a first direction in a second direction perpendicular to the first direction; and preliminarily ejecting ink from a nozzle formed in the inkjet head into an ink storage unit facing the inkjet head through the open part when the open part of the paper is conveyed to a position opposite the inkjet head.

Further preferably, the preliminary ejection method also has steps of: detecting the open part of the paper while conveying the paper in the second direction; determining when the open part is conveyed to a position opposite the inkjet head based on detected information about the open part; and preliminarily ejecting ink into the ink storage unit when the open part of the paper was conveyed to a position opposite the inkjet head.

With this method, the inkjet printer can detect the position of the open part of the inkjet paper conveyed in the paper feed step in the open part detection step. Ink can also be ejected from the inkjet head through the open part into a waste ink storage unit disposed at a position opposite the inkjet head with the paper feed path therebetween to flush the inkjet head. The inkjet head can therefore be flushed when inkjet paper is in the paper feed path while preventing the flushed waste ink from landing on the surface of the inkjet paper. The inkjet printer can therefore maintain the appearance of the recording part of the inkjet paper, and reduce soiling of the inkjet paper and the area around the paper feed path.

Other objects and attainments together with a fuller understanding of the invention will become apparent and appreciated by referring to the following description and claims taken in conjunction with the accompanying drawings.

DESCRIPTION OF EMBODIMENTS

Preferred embodiments of the present invention are described below with reference to the accompanying figures. Note that for convenience of description and illustration, the horizontal and vertical scale of members and parts shown in the figures may differ from the actual scale.

General Configuration of an Inkjet Printer

Figure 1:
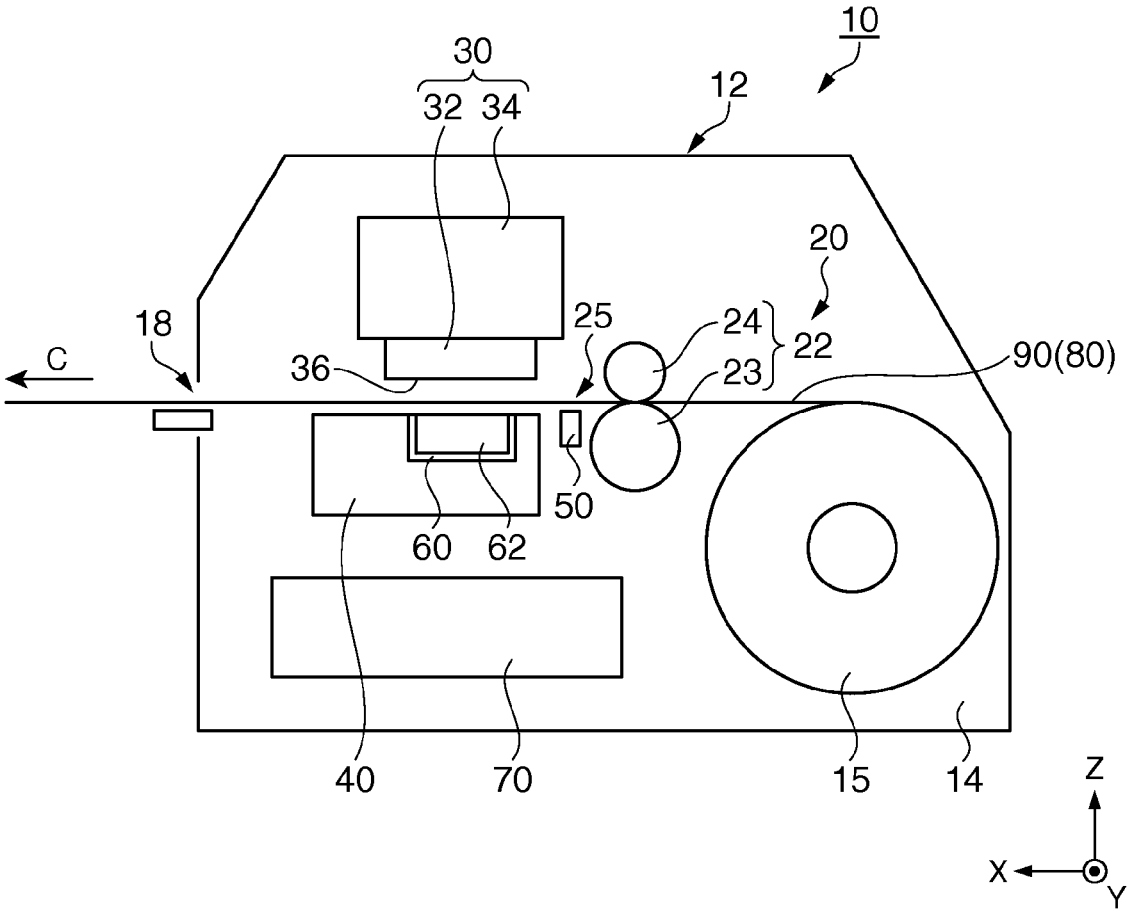
FIG. 1 is a section view showing the general configuration of an inkjet printer.

The general configuration of an inkjet printer in which inkjet paper according to this embodiment of the invention is used is described first with reference to FIG. 1. FIG. 1 is a section view showing the general configuration of an inkjet printer. Note that the x-axis shown in FIG. 1 indicates the conveyance direction of the inkjet paper (second direction), the y-axis indicates the width of the inkjet paper (first direction), and the z-axis indicates the direction perpendicular to the x-axis and the y-axis.

As shown in FIG. 1, the inkjet printer 10 (referred to below as the printer 10) is housed in a basically rectangular box-like outside case 12, and includes a roll paper compartment 14, paper feed unit 20, recording unit 30, platen 40, opening detection unit 50, flushed ink storage unit 60, and a control device 70 that centrally controls these other parts.

The printer 10 prints by recording information on inkjet paper 80 using plural colors of ink. This embodiment uses label paper 90 having labels fixed with a specific interval therebetween to one side of a continuous liner as an example of inkjet paper 80. This label paper 90 is described in detail below.

The continuous label paper 90 used as the inkjet paper 80 is wound into a paper roll 15, and the paper roll 15 is stored so that it can rotate freely in the roll paper compartment 14. The web of label paper 90 pulled from the paper roll 15 stored in the roll paper compartment 14 is fed by the paper feed unit 20 described below through the paper feed path 25 along the x-axis inside the printer 10, and is discharged from the paper exit 18 formed in one side of the outside case 12.

The paper feed unit 20 is disposed on the downstream side of the roll paper compartment 14 in the forward conveyance direction (in the direction of arrow C toward the paper exit 18) of the inkjet paper 80 through the conveyance path 25. The paper feed unit 20 has one paper feed roller pair 22. The paper feed roller pair 22 includes a feed roller 23 and a pressure roller 24. The feed roller 23 is cylindrically shaped and made of rubber or other elastic material, receives rotational drive power from a paper feed motor not shown, and rotates on an axis parallel to the paper width. The pressure roller 24 is also cylindrically shaped and made of rubber or other elastic material, and is pressed to the feed roller 23 with a constant pressure to rotate freely.

The label paper 90 is held between the feed roller 23 and pressure roller 24. The label paper 90 held between the rotationally driven feed roller 23 and the pressure roller 24 that follows the rotation of the feed roller 23 is fed at a specific pitch forward or reverse in conjunction with roller rotation. The length of the feed roller 23 and the pressure roller 24 in the axial direction is greater than or equal to the maximum width of the label paper 90.

The opening detection unit 50 is disposed on the conveyance path 25 on the downstream side of the feed roller 23 of the paper feed unit 20. The opening detection unit 50 may be a reflective photosensor, for example, and detects the position of openings formed in the liner part of the label paper 90. The opening detection unit 50 could detect the actual openings, or detect markings printed on the back of the liner and calculate the positions of the openings. Further alternatively, the opening detection unit 50 could detect the positions of the labels as the recording area on the liner based on the sensor output.

The recording unit 30 is disposed to the conveyance path 25 on the downstream side of the paper feed unit 20 in the label paper 90 conveyance direction (direction C). The recording unit 30 includes an inkjet head 32 and carriage 34. The inkjet head 32 has plural nozzles 36 that eject black, cyan, yellow, and magenta ink, and the plural nozzles 36 are formed in nozzle rows arranged in lines. The inkjet head 32 is wider than the label paper 90, and the nozzle rows are arrayed on the y-axis in FIG. 1 in an area of a width that covers the entire recording area of the label paper 90.

The inkjet head 32 is mounted on a carriage 34 so that the plural nozzles 36 that eject ink face down on the z-axis in FIG. 1. The carriage 34 in this embodiment is fixed to the conveyance path 25. The inkjet head 32 ejects ink as ink droplets to the recording area on the labels of the label paper 90 conveyed by the paper feed unit 20 described above. An inkjet printer 10 having this type of inkjet head 32 is called an inkjet line printer.

The platen 40 is disposed opposite the inkjet head 32 on the z-axis with a constant gap to the nozzle 36 face of the inkjet head 32. The platen 40 has a flat rectangular shape that is long on the y-axis, and a plurality of longitudinal ribs extending in the label paper 90 conveyance direction are formed with a specific gap therebetween on the surface of the platen 40. The surface of the platen 40 defines the recording position of the inkjet head 32. The platen 40 has the flushed ink storage unit 60 at a position opposite the nozzles 36 of the inkjet head 32 mounted on the carriage 34.

The flushed ink storage unit 60 is shaped like a box with the area opposite the nozzles 36 of the inkjet head 32 open in the surface of the platen 40, and a sponge 62 that absorbs the flushed waste ink fills the inside of the box. The sponge 62 may be felt, for example. Alternatively, the flushed waste ink could be suctioned through a tube not shown from the flushed ink storage unit 60 into a waste ink cartridge not shown.

The control device 70 is disposed in the bottom of the outside case 12 of the printer 10, and centrally controls the other components described above. The control device 70 is described in detail below.

Printer Control

Figure 2:
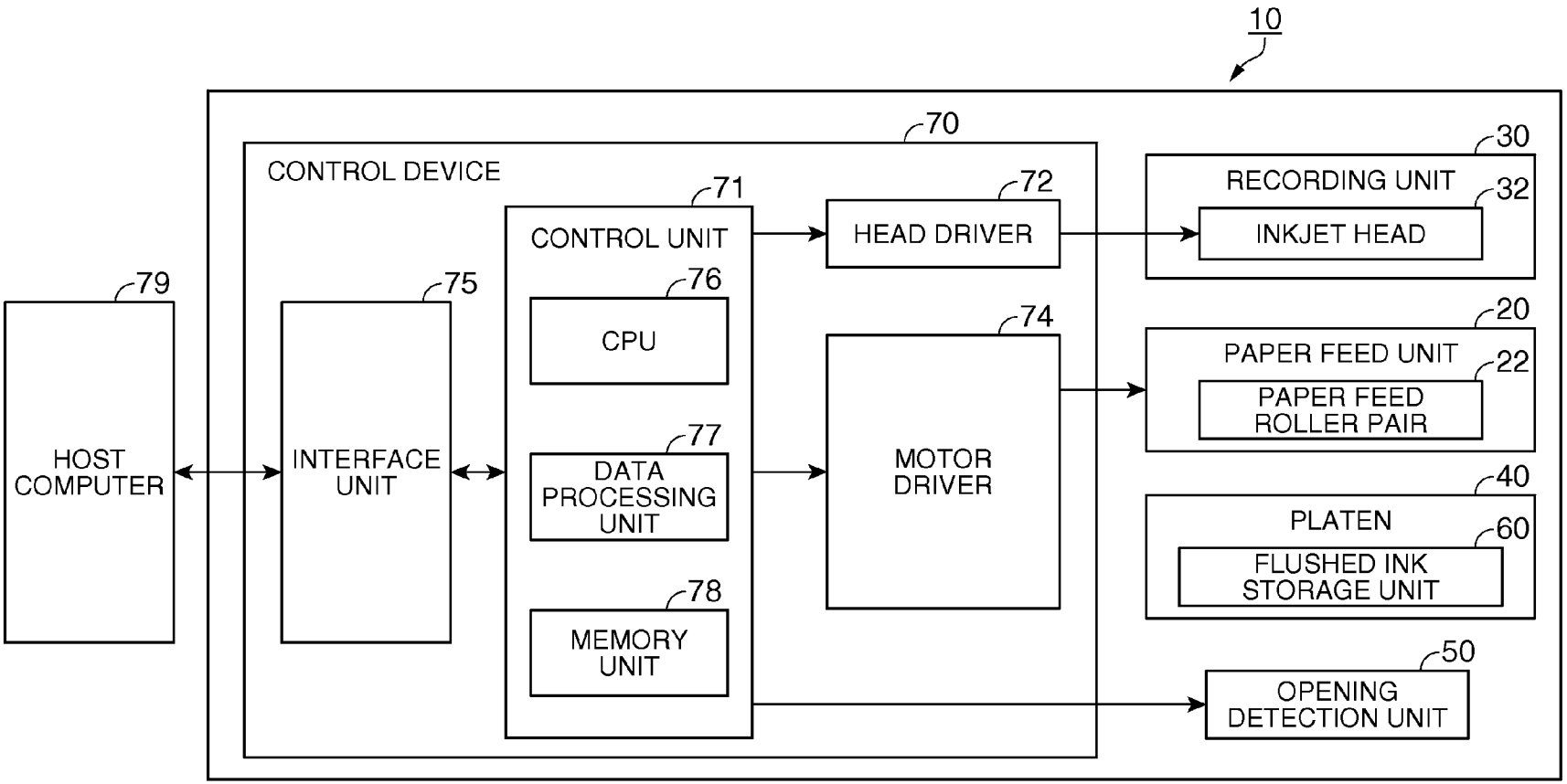
FIG. 2 is a block diagram used to describe inkjet printer control.

The printer control system is described next with reference to FIG. 2. FIG. 2 is a block diagram showing the main configuration of the printer. As shown in FIG. 2, the printer 10 has a paper feed unit 20, a recording unit 30 including the inkjet head 32, a opening detection unit 50, and a control device 70 (print control unit) that centrally controls these other parts.

The control device 70 includes a control unit 71 that is the main part of the control system, a head driver 72 that controls driving the inkjet head 32, a motor driver 74 that drives the paper feed unit 20, and an interface unit 75. The control unit 71 includes a CPU (central processing unit) 76, data processing unit 77, and memory unit 78. The CPU 76 executes processes including a recording process and an input signal process that processes signals from the operating system not shown and detection system including the opening detection unit 50. The data processing unit 77 processes information.

The memory unit 78 includes RAM (random access memory), ROM (read-only memory), or other memory device not shown. RAM temporarily stores data, including the print data input from the host computer 79 through the interface unit 75, and programs such as the recording process executed by the CPU 76. The print data describes the text, image, or other pattern to be recorded on the label paper 90 by the inkjet head 32.

The head driver 72 controls the inkjet head 32 based on commands from the CPU 76. The motor driver 74 controls the motor of the paper feed unit 20 based on commands from the CPU 76. The interface unit 75 outputs print data received from the host computer 79 to the head driver 72, and outputs information received from the control unit 71 to the host computer 79.

A printer 10 configured as described above ejects ink and records information on the conveyed label paper 90 with the inkjet head 32 of the recording unit 30 while conveying the label paper 90 through the conveyance path 25 with the paper feed unit 20 shown in FIG. 1 in specific paper feed increments on the x-axis. The label paper 90 on which information was recorded is then discharged from the paper exit 18.

The printer 10 performs a maintenance operation at specific times in order to maintain desirable ink ejection characteristics from the nozzles 36 of the inkjet head 32. For example, if the printer 10 is not used for a specific length of time, bubbles can become mixed with the ink or ink viscosity may increase due to evaporation of the solvent. Foreign matter such as paper dust can also stick to the area around the nozzles 36. These events can become a cause of degraded ink ejection characteristics. When severe, ink ejection may not be possible. As a result, the printer 10 ejects ink at a specific timing to remove the foregoing causes of ejection problems. This operation is called preliminary ejection or flushing, and is controlled by the control device 70 described above.

Inkjet paper

Embodiment 1

Figure 3A:
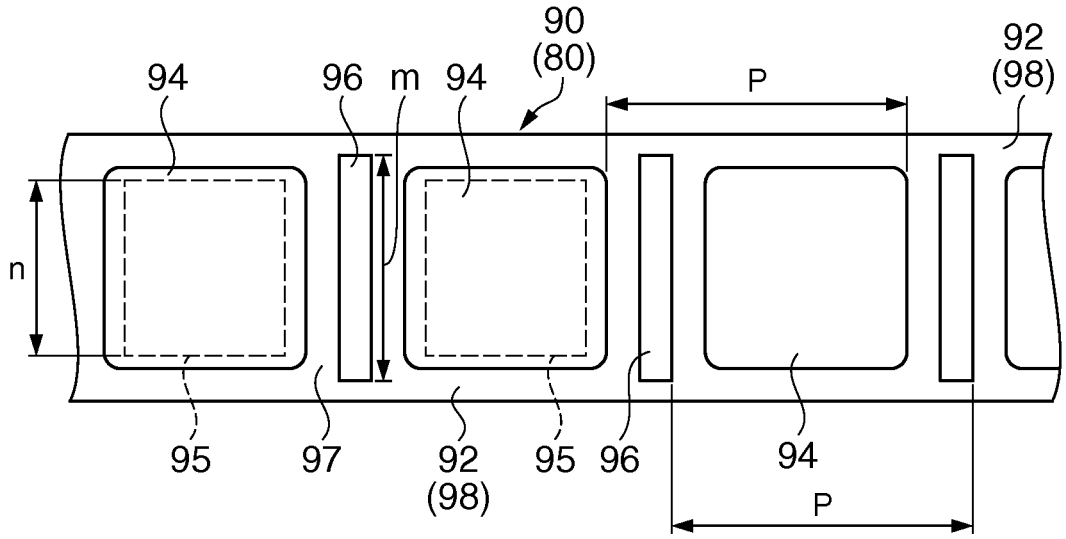
FIGS. 3A-3B show an example of inkjet paper according to a first embodiment of the invention.
Figure 3B:
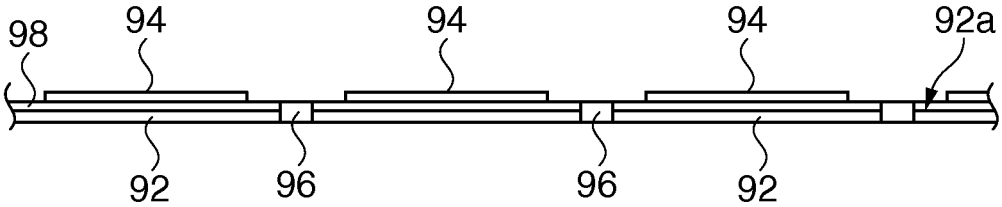

Inkjet paper 80 according to a first embodiment of the invention is described below with reference to FIG. 3. FIG. 3 shows an example of inkjet paper 80 according to the first embodiment of the invention, and more specifically shows an example of label paper. FIG. 3A is a plan view from the label side, and FIG. 3B is a section view of the label paper. An embodiment using this label paper as the inkjet paper 80 is described below.

As shown in FIG. 3, the label paper 90 used as the inkjet paper 80 has a liner 92 and labels 94. The labels 94 are rectangular with an adhesive coating on the back side. The front of each label 94 is the recording area 95 where the printer 10 records information. The labels 94 are affixed continuously at a specific pitch P along the length (second direction) of one side of the liner 92.

The liner 92 is a continuous web with a specific width in the first direction, and has a coating 98 on one side 92*a* that facilitates peeling the labels 94 from the liner 92. Openings 96, which are rectangular holes, are formed in the liner 92 at a specific pitch P along the length in the areas where a label 94 is not affixed (referred to as the non-recording areas 97 below).

The length m of the opening 96 across the width of the liner 92 (first direction) is at least equal to the width of the labels 94, or greater than the length n of the width of the recording area 95. The length of the opening 96 lengthwise to the label paper 90 (in the conveyance direction) is set to a desirable length. The shape of the opening 96 is also not limited to rectangular, and any desirable shape can be used.

Preliminary Ejection Operation

Figure 4:
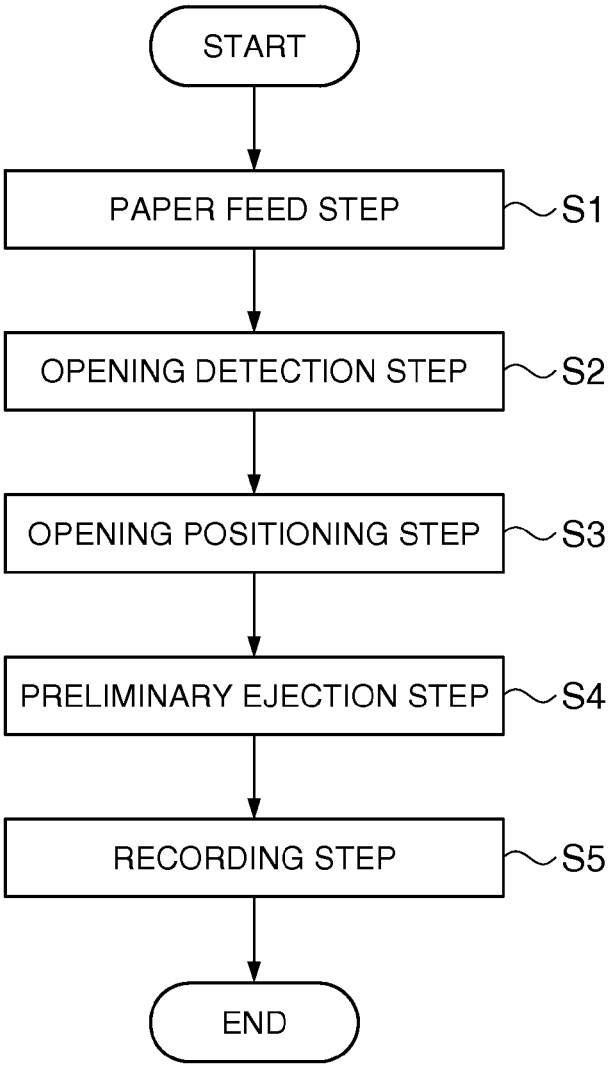
FIG. 4 is a flow chart of the preliminary ejection operation of the inkjet printer.

The preliminary ejection operation is described next with reference to FIG. 4. FIG. 4 is a flowchart of the preliminary ejection operation. An example using the printer described above and label paper 90 as the inkjet paper 80 is described below.

As shown in FIG. 4, the preliminary ejection operation includes a paper feed step S1, opening detection step S2, opening positioning step S3, preliminary ejection step S4, and a recording step S5.

Preliminary ejection occurs when ink has not been ejected from the inkjet head 32 for a specific time, such as when printing is stopped for a specific time after printer 10 power turns on, or the preliminary ejection switch is pressed. This operation is performed in response to a command from the control unit 71 shown in FIG. 2.

The paper feed unit 20 shown in FIG. 1 conveys the label paper 90 through the conveyance path 25 at a specific pitch in the direction of arrow C in FIG. 1 in the paper feed step S1 shown in FIG. 4. In the opening detection step S2, the opening detection unit 50 disposed to the conveyance path 25 detects the openings 96 in the label paper 90 shown in FIG. 3 conveyed through the conveyance path 25, or markings not shown printed on the back of the liner 92, and detects the position of an opening 96.

The opening positioning step S3 positions the opening 96 in the label paper 90 detected in the opening detection step S2 between the nozzles 36 of the inkjet head 32 and the flushed ink storage unit 60 disposed in the platen 40. More specifically, the paper feed unit 20 shown in FIG. 1 conveys the label paper 90 a specific distance to position the opening 96.

In the preliminary ejection step S4, ink is ejected from the nozzles 36 of the inkjet head 32 through the opening 96 in the label paper 90 onto the sponge 62 in the flushed ink storage unit 60 based on a command from the control unit 71 shown in FIG. 2. Plural settings are predefined for the color of ink, the ejection volume, and the ejection period based on various conditions. The preliminary ejection step S4 eliminates the cause of ejection problems, including air bubbles in the ink, ink viscosity, and dust on the nozzle face, and maintains good ink ejection characteristics.

The recording step S5 then records the desired information in the recording area 95 of the label 94 on the label paper 90 conveyed by the paper feed unit 20 using an inkjet head 32 with good ejection characteristics.

The effect of the first embodiment is described below.

(1) The label paper 90 used as inkjet paper 80 has openings 96 with a length m equal to the length n of the width or greater than the length n of the width of the recording area 95 formed in the liner 92 to which the labels 94 with a recording area 95 are affixed. As a result, the ink flushed from the inkjet head 32 is discharged through the opening 96 into the flushed ink storage unit 60 disposed in the conveyance path 25 of the printer 10. As a result, the flushed ink can be prevented from landing on the surface of the label paper 90. The appearance of the recording part of the label paper 90 can therefore be maintained, and soiling the label paper 90 and the area around the conveyance path 25 can be reduced.

(2) The printer 10 can perform the preliminary ejection operation even while a web of recording paper remains in the conveyance path 25 by using this label paper 90 as the inkjet paper 80 described above. There is, therefore, no need to move the inkjet head 32 or temporarily remove the recording paper to flush the nozzles. A user-friendly printer 10 that can easily maintain the inkjet head 32 can therefore be provided.

Other Embodiments

Other embodiments of the invention are described next with reference to FIG. 5. FIG. 5 describes another example of inkjet paper according to the invention. Note that like parts and content that is the same as in the first embodiment are identified by the same reference numerals and further description thereof is omitted.

Figure 5A:
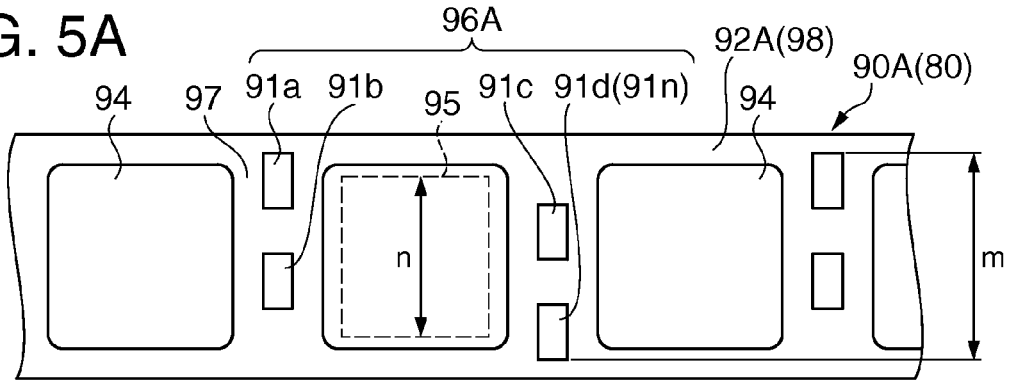
FIGS. 5A-5D show an example of inkjet paper according to another embodiment of the invention.

As shown in FIG. 5A, label paper 90A used as inkjet paper 80 has a liner 92A and labels 94 identical to those in the first embodiment. The liner 92A is formed as a continuous web with a specific width, and has a coating 98. A group of openings 96A including plural (four in this embodiment) rectangular holes 91*a*,91*b*,91*c*,91*d* is formed in the liner 92A in the non-recording area 97 where labels 94 are not affixed. The group of openings 96A is divided into a set of holes 91*a*, 91*b* and a set of holes 91*c*,91*d* with the label 94 therebetween in the lengthwise direction.

The total length m of the width of the four holes 91*a*,91*b*, 91*c*, 91*d* is (the length of the width from one end of hole 91*a* to the other end of hole 91*d*) is at least equal to the width of the label 94, or greater than the length n of the width of the recording area 95. The length of the holes 91*a*,91*b*,91*c*,91*d* lengthwise to the label paper 90 is set to a desirable length. The number and the shape of the holes 91*n* (n=4 in FIG. 5A) are also not limited, and can be changed as desired.

The continuous length of the holes 91*n* formed widthwise to the label paper 90A can thus be reduced. A loss of rigidity in the label paper 90A can therefore be prevented. As a result, stable conveyance of the label paper 90A can be maintained while ink can be flushed through these groups of openings 96A. The flushed ink can therefore be prevented from landing on the surface of the label paper 90A.

Figure 5B:
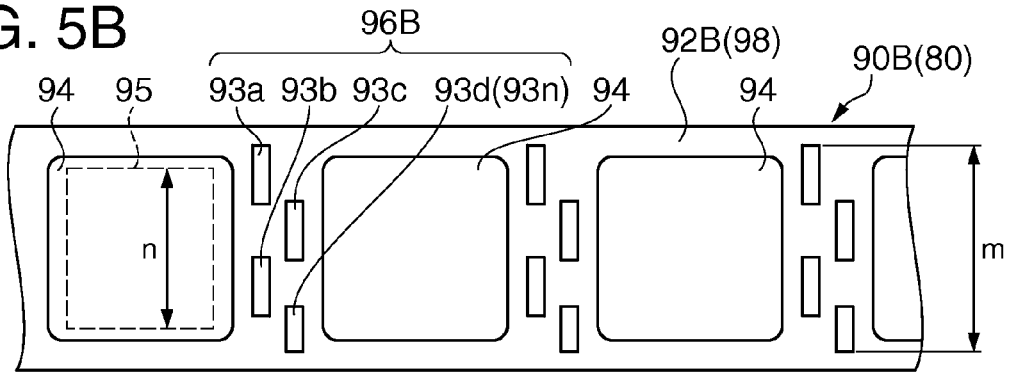

Further alternatively as shown in FIG. 5B, label paper 90B used as inkjet paper 80 has a liner 92B and labels 94 identical to those in the first embodiment. The liner 92B is formed as a continuous web with a specific width, and has a coating 98. A group of openings 96B including plural (four in this embodiment) rectangular holes 93*a*,93*b*, 93*c*,93*d* in the non-recording areas 97 where a label 94 is not affixed is formed in the liner 92B. The group of openings 96B is formed between two labels 94.

The total length m of the width of the four holes 93*a*,93*b*, 93*c*, 93*d* is (the length of the width from one end of hole 93*a* to the other end of hole 93*d*) is at least equal to the width of the label 94, or greater than the length n of the width of the recording area 95. The length of the holes 93*a*,93*b*,93*c*,93*d* lengthwise to the label paper 90 is set to a desirable length. The number and the shape of the holes 93*n* are also not limited, and can be changed as desired.

The length of the holes 93*n* formed consecutively widthwise can be reduced with this label paper 90B. A loss of rigidity in the label paper 90B can therefore be prevented. All nozzles 36 can also be flushed before recording information on one label 94. As a result, stable conveyance of the label paper 90B can be maintained while ink can be flushed through these groups of openings 96B. The flushed ink can therefore be prevented from landing on the surface of the label paper 90B.

Figure 5C:
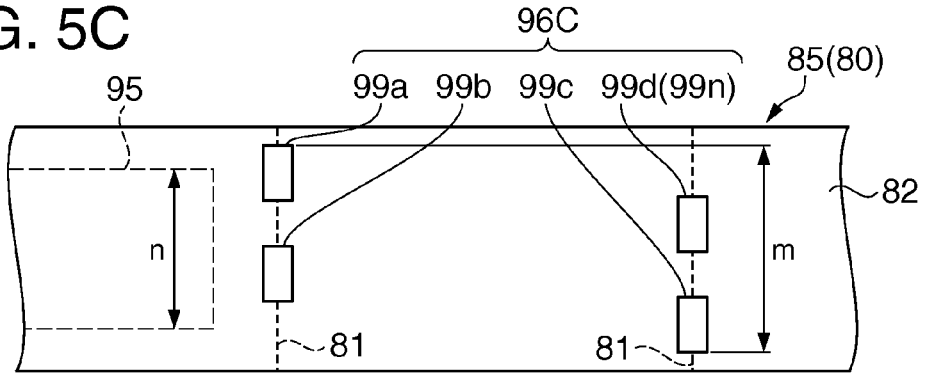

As shown in FIG. 5C, fanfold paper 85 made from continuous paper 82 with perforations 81 formed in the continuous paper 82 web at specific intervals in the conveyance direction can also be used as the inkjet paper 80. This fanfold paper 85 is folded back and forth at the perforations 81, and used as a continuous web.

A group of openings 96C including plural (four in this embodiment) rectangular holes 99*a*,99*b*,99*c*,99*d* that are larger than the holes forming the perforations 81 are formed in the continuous paper 82 straddling the perforations 81 in an area outside the recording area 95. More specifically, the perforation 81 is formed extending in the direction of the width of the holes 99*a*,99*b* (first direction). The group of openings 96C is divided into a set of holes 99*a*,99*b* and a set of holes 99*c*,99*d* with one recording area 95 therebetween in the lengthwise direction.

The total length m of the width of the four holes 99*a*,99*b*, 99*c*, 99*d* is (the length of the width from one end of hole 99*a* to the other end of hole 99*c*) is at least greater than the length n of the width of the recording area 95. The length of the holes 99*a*,99*b*,99*c*,99*d* in the lengthwise direction is set to a desirable length. The number and the shape of the holes 99*n* (n=4 in FIG. 5A) are also not limited, and can be changed as desired.

This fanfold paper 85 enables flushing ink through the group of openings 96C. Flushed ink can therefore be prevented from landing on the surface of the fanfold paper 85.

Figure 5D:
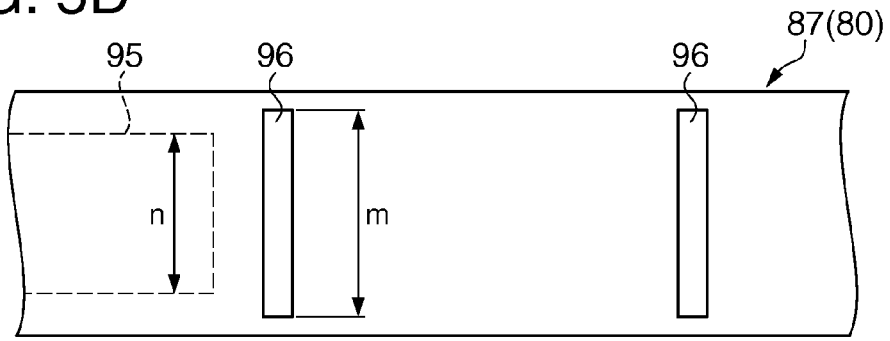

As shown in FIG. 5D, continuous paper 87 can also be used as inkjet paper 80. This continuous paper 87 has openings 96 formed with a specific interval therebetween in the conveyance direction. The length m of the width of the opening 96 is at least greater than the length n of the width of the recording area 95 as shown in FIG. 5D. The length of the openings 96 lengthwise to the continuous paper 87 can be set to the desired length. The shape of the openings 96 is not limited to rectangular, and any desired shape can be used.

The continuous paper 87 thus enables flushing ink through the openings 96. The flushed ink can therefore be prevented from landing on the surface of the continuous paper 87.

Preferred embodiments of the invention are described above, but can be modified in many ways without departing from the scope of the accompanying claims.

For example, the width of the recording area 95 could be the length of the width to which ink ejection can be controlled by the head driver 72 that controls the inkjet head 32, or the length from one end to the other end of the nozzles 36 formed in the inkjet head 32 on the y-axis.

Further preferably, holes 91*a* and 91*c* of the four holes 91*a*,91*b*, 91*c*,91*d* shown in FIG. 5A overlap in the conveyance direction of the recording paper, and holes 91*b* and 91*d* overlap in the conveyance direction of the recording paper. This can prevent ink from landing on the recording paper when ink is ejected from the nozzles 36 of the inkjet head 32 in the boundary between holes 91*a* and 91*c*,and the nozzles 36 in the boundary between holes 91*b* and 91*d*.This configuration is also preferably applied to the configurations shown in FIG. 5C and FIG. 5D.

The width of the opening is also the length of the recording area 95 in the width direction or greater than the length of the recording area 95 in the width direction, but a configuration in which the width of the opening is shorter than the length of the recording area 95 in the width direction is also conceivable. By forming an opening at a position opposite the nozzles 36 that eject ink infrequently due to the recorded information or the nozzle configuration, this configuration enables ejecting ink from the nozzles 36 that are particularly susceptible to ejection problems so that nozzle ejection problems can be better prevented.

The invention being thus described, it will be obvious that it may be varied in many ways. Such variations are not to be regarded as a departure from the spirit and scope of the invention, and all such modifications as would be obvious to one skilled in the art are intended to be included within the scope of the following claims.

The entire disclosure of Japanese Patent Application No: 2011-249414,filed Nov. 5, 2011 is expressly incorporated by reference herein.

What is claimed is:

1. An inkjet printer comprising:

an inkjet head that has a nozzle configured to eject ink in a first direction for recording information;

a platen that has an ink storage unit configured to store the ink ejected from the nozzle, wherein said platen is opposite the inkjet head and configured to guide paper formed with an open part;

a paper feed unit that is configured to convey the paper in a second direction cross to the first direction, and to move the paper over the platen; and a print control unit that is configured to cause the nozzle to eject ink into the ink storage unit when the open part of the paper is conveyed to a position opposite the inkjet head.

2. The inkjet printer described in claim 1, wherein the open part of the paper has a first opening, and a second opening formed separated from the first opening in the first direction and the second direction, and the print control unit is configured to cause the nozzle of the inkjet head to eject ink into the ink storage unit when the first opening is conveyed to a position opposite the inkjet head, and to cause the nozzle of the inkjet head to eject ink into the ink storage unit when the second opening is conveyed to a position opposite the inkjet head.

3. The inkjet printer described in claim 1, further comprising:

an open part detection unit that is configured to detect the open part formed in the paper, wherein the print control unit is configured to determine whether the open part of the paper was conveyed to a position opposite the inkjet head based on an output from the open part detection unit.

4. The inkjet printer described in claim 1, wherein the paper has a recording area in which information is to be recorded; and the print control unit is configured to cause the nozzle to eject ink when the recording area of the paper is conveyed to a position opposite the inkjet head such that the information is recorded in the recording area.

5. The inkjet printer described in claim 1, wherein the inkjet head is an inkjet line head disposed to a fixed position opposite the platen with the ink storage unit.

6. A preliminary ejection method for an inkjet printer, said method comprising:

conveying paper, formed with an open part in a first direction, in a second direction perpendicular to the first direction; and preliminarily ejecting ink, from a nozzle of an inkjet head into an ink storage unit facing the inkjet head, through the open part when the open part of the paper is conveyed to a position opposite the inkjet head.

7. The preliminary ejection method described in claim 6, further comprising:

detecting the open part of the paper while conveying the paper in the second direction;

determining whether the open part is conveyed to a position opposite the inkjet head based on detected information about the open part; and preliminarily ejecting ink into the ink storage unit when the open part of the paper was conveyed to the position opposite the inkjet head.

* * * * *